US008189846B2

(12) United States Patent
Tiscareno et al.

(10) Patent No.: US 8,189,846 B2
(45) Date of Patent: May 29, 2012

(54) VENTED IN-THE-EAR HEADPHONE

(75) Inventors: Victor M. Tiscareno, Issaquah, WA (US); Kurt R. Stiehl, San Jose, CA (US)

(73) Assignee: Apple Inc., Cupertino, CA (US)

( * ) Notice: Subject to any disclaimer, the term of this patent is extended or adjusted under 35 U.S.C. 154(b) by 883 days.

(21) Appl. No.: 12/205,547

(22) Filed: Sep. 5, 2008

(65) Prior Publication Data

US 2010/0061580 A1 Mar. 11, 2010

(51) Int. Cl.
*H04R 1/10* (2006.01)

(52) U.S. Cl. ..... 381/380; 381/381; 381/322

(58) Field of Classification Search ..... 381/380, 381/322, 328; 181/130
See application file for complete search history.

(56) References Cited

U.S. PATENT DOCUMENTS

| | | | | |
|---|---|---|---|---|
| 4,880,076 | A | 11/1989 | Ahlberg et al. | |
| 5,002,151 | A | 3/1991 | Oliveira et al. | |
| 5,033,090 | A | 7/1991 | Weinrich | |
| 5,319,163 | A * | 6/1994 | Scott | 181/130 |
| 7,570,777 | B1 * | 8/2009 | Taenzer et al. | 381/381 |
| 7,784,583 | B1 * | 8/2010 | Hall et al. | 181/130 |
| 2005/0244026 | A1 * | 11/2005 | Nielsen et al. | 381/380 |
| 2006/0067551 | A1 * | 3/2006 | Cartwright et al. | 381/322 |
| 2007/0201717 | A1 * | 8/2007 | Dyer et al. | 381/380 |

OTHER PUBLICATIONS

"ER-3A ABR Insert Earphone", Admitted Prior Art, (2 pages) Feb. 2000.

Fagelson, Marc A., et al., "The Occlusion Effect and Ear Canal Sound Pressure Level", American Journal of Audiology, vol. 7, 50-54, Oct. 1998, American Speech-Language-Hearing Association, (1 page).

Frye, George , "The FONIX CIC Option", Admitted Prior Art, (3 pages) Sep. 2005.

* cited by examiner

*Primary Examiner* — Davetta W Goins
*Assistant Examiner* — Phan Le
(74) *Attorney, Agent, or Firm* — Blakely, Sokoloff, Taylor & Zafman LLP

(57) ABSTRACT

A vented tip for in-the-ear headphones has a core portion to be mounted to a sound output tube of an in-the-ear earphone and a flange portion extending outward from and surrounding the core portion. The vented tip has a) an outer portion formed in the flange portion that is to be in contact with, and thereby form a seal with, a user's ear canal, and b) an inner portion spaced inwards from the outer portion to thereby not form the seal with the user's ear canal. The inner portion has a calibrated perforation or hole formed therein. Other embodiments that may help reduce bone conduction effects are also described and claimed.

15 Claims, 4 Drawing Sheets

(SIDE CROSS-SECTION)

(FRONT OUTSIDE VIEW)

(SIDE CROSS-SECTION)

(FRONT OUTSIDE VIEW)

(SIDE CROSS-SECTION)

VENTED IN-THE-EAR HEADPHONE

FIELD OF THE INVENTION

An embodiment of the invention relates to improving the sound quality of insert earphones (also referred to as in-the-ear or in-the-canal headphones) by venting or leakage, to reduce bone conduction effects.

BACKGROUND

Whether listening to an MP3 player while traveling, or to a high-fidelity stereo system at home, consumers are increasingly choosing the in-ear earphone for their listening pleasure. This electro-acoustic transducer device has a relatively low profile that provides convenience for the wearer, while also providing very good sound quality. An in-the-ear headphone, also referred to as an "earbud", has a receiver or driver (an earpiece speaker) inside a housing that has an acoustic output tube. The open end of the latter is to be inserted into the wearer's ear canal. The tube is a rigid member that may be fitted with a flexible and resilient tip or cap typically made of a rubber or silicone material. The tip may be custom molded for the discerning audiophile, or it may be a high volume manufactured piece. The tip has an inner diameter that is slightly smaller than the outer diameter of the output tube. The user stretches the tip outward (in a radial direction), to enable it to easily slide (in a longitudinal direction) over the open end of the housing's output tube. The tip is then released, which causes it to collapse inward and grip the output tube. When such a headphone is then is inserted into the user's ear, a flared portion of the ear tip becomes compressed against the ear canal wall and thereby creates a sealed (essentially airtight) cavity inside the canal. This provides the wearer with good acoustic isolation against external sounds.

Consumers can wear in-the-ear headphones while conducting various types of daily activity, including not just sitting calmly and listening to music, but also while walking, exercising vigorously, and talking on a telephone call. This increased level of physical activity, however, results in the lower frequency or bass sounds that are being heard by the user to be amplified inadvertently by the headphone. This may be due to the headphone tip forming a very good seal with the user's ear canal wall, thereby creating an occluded cavity therein. Studies have shown that the sound pressure levels in the ear canal, produced by an external vibration source, are greater in the occluded ear than in the un-occluded or open-to-free-air condition. This effect is also referred to as bone conduction, because the user experiences the effect of external vibrations through the skull or other parts of the user's body outside the ear canal.

SUMMARY

Several embodiments of the invention are directed to vented, in-the-ear headphones (earphones) that may reduce or ameliorate the undesirable acoustic effects of bone conduction.

One embodiment is a vented tip for an in-the-ear headphone. A core portion of the tip is to be mounted or installed to a sound output tube of an earphone case. A flange portion extends outward from and surrounds the core portion. The vented tip has an outer portion formed in the flange portion that is to be in contact with, and thereby form a seal with, a user's ear canal (when the tip has been installed to the sound output tube and fitted to the user's ear). In addition, the vented tip has an inner portion that is spaced inwards from the outer portion to thereby not form the seal with the user's ear canal (when the tip has been installed to the sound output tube and has been fitted to the user's ear). In other words, the inner portion is spaced inwards from the outer portion to thereby not be in contact with a wall of the user's ear canal. This inner potion has a calibrated, front-to-back perforation or hole formed therein. The perforation or hole remains open for venting or leakage, even when the tip has been installed to the earphone sound output tube and has been fitted to the user's ear. Such an ear tip may be interchanged with a "full seal" tip and may be used when the user is for example exercising vigorously. The headphone may be packaged together with both types of ear tips, to be sold as a single item.

In another embodiment, the venting or leakage is achieved using a calibrated, open trench or trough. The trench is formed on the outer surface of the flange portion and extends generally longitudinally or in a front-to-back direction across a contact section of the flange that will be compressed while in contact with the ear canal wall (when the headphone has been inserted into the wearer's ear). The structure and/or material of at least the contact section should be designed to prevent the trench from collapsing too much (due to the compression forces that are created) when the headphone is inserted into the ear canal, so that sufficient venting takes place through the trench during use of the headphone.

In yet another embodiment, a calibrated, front-to-back vent passage is formed through a wall of the earphone case sound output tube. The vent passage is separate from and in addition to the main sound output port of the earphone case. The vent passage may be routed or ported, from the free air outside the case, through the wall of the sound output tube and into the ear canal. In cases where a tip is used that covers the back end of the vent passage, the tip itself may need to be ported at a location that lines up with the back end of the passage, to allow the covered back end to communicate with free air. In that case, the ported portion of the tip may be considered as formed in the core portion of the tip, as compared to the latter's flange portion.

The vent passage that is formed through the wall of the sound output tube has at least two bore segments. A front bore segment may be formed in a cap (e.g., one having a mesh or grill surface as in a typical earphone) that is located in front of a base, both being in effect part of the case sound output tube. The front bore segment may be always open to the occluded cavity in the ear canal. A rear bore segment of the vent passage may be formed in the base and may always be open to the free air outside the earphone case. The cap may be connected to the base so that it can be manually rotated relative to the base by the wearer, between at least two stable positions or states. In one state, which may be called the vigorous exercise or work out position, the front and rear segments are aligned to thereby vent the ear canal cavity. In another state, namely the normal or high fidelity position, at least the front segment is blocked to thereby not vent the ear canal cavity.

In a further embodiment, venting is achieved by carefully porting the inner surface of the ear tip so that, once the tip has been installed in a typical manner onto the earphone case sound output tube, a calibrated vent passage or port that runs generally longitudinally or in a front-to-back direction is created when the ported inner surface of the ear tip is joined with the outer surface of the case sound output tube. This passage extends from the front of the case sound output tube, which opens into the ear canal cavity, rearward along the outer surface of the case sound output tube, and then opens to the free air outside the case. In this embodiment, the vent passage may be considered as formed in the core portion of the tip, as compared to the latter's flange portion.

The above summary does not include an exhaustive list of all aspects of the present invention. Indeed, it is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above Summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

In this section several embodiments of this invention are explained with reference to the appended drawings. Whenever the shapes, relative positions and other aspects of the parts described in the embodiments are not clearly defined, the scope of the invention is not limited only to the parts shown, which are meant merely for the purpose of illustration.

Figure 1:
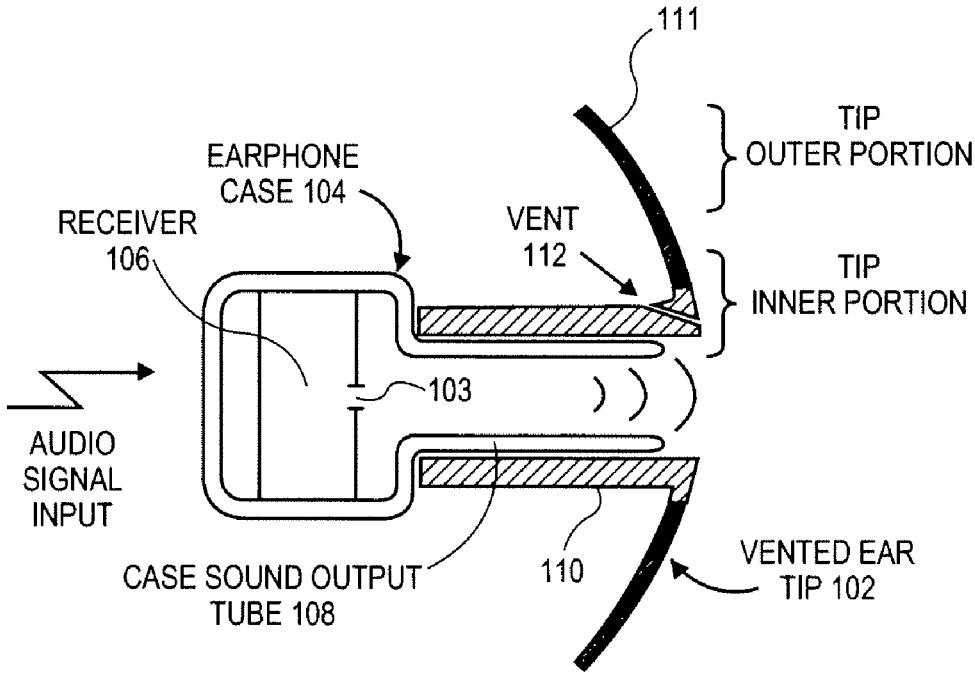
FIG. 1 shows a side view of a cross section of an example vented ear tip as installed to an earphone case.

FIG. 1 is a side view of a cross section of an example earphone assembly in accordance with an embodiment of the invention. A vented ear tip 102 has been fitted to an earphone case 104, making the in-the-ear headphone thus ready to be inserted into the user's ear canal. The earphone case 104 houses a receiver 106 (also referred to as an earpiece speaker or a driver). The receiver 106 may be fixed in position relative to an inside of the earphone case 104 as shown. The receiver has an electrical signal input port to receive an input electrical audio signal. The receiver converts the input or incoming electrical audio signal into sound pressure waves that are delivered through its at least one receiver sound output port 103. These open into a sound chamber or other volume inside the case 104 that is further coupled acoustically to a case sound output tube 108. The shape of the sound chamber and the case sound output tube 108 as well as the material of its interior walls may be designed to promote the quality of sound delivered from the receiver 106 through the port 103 and that is then heard by the wearer or user of the headphone.

Figure 6:
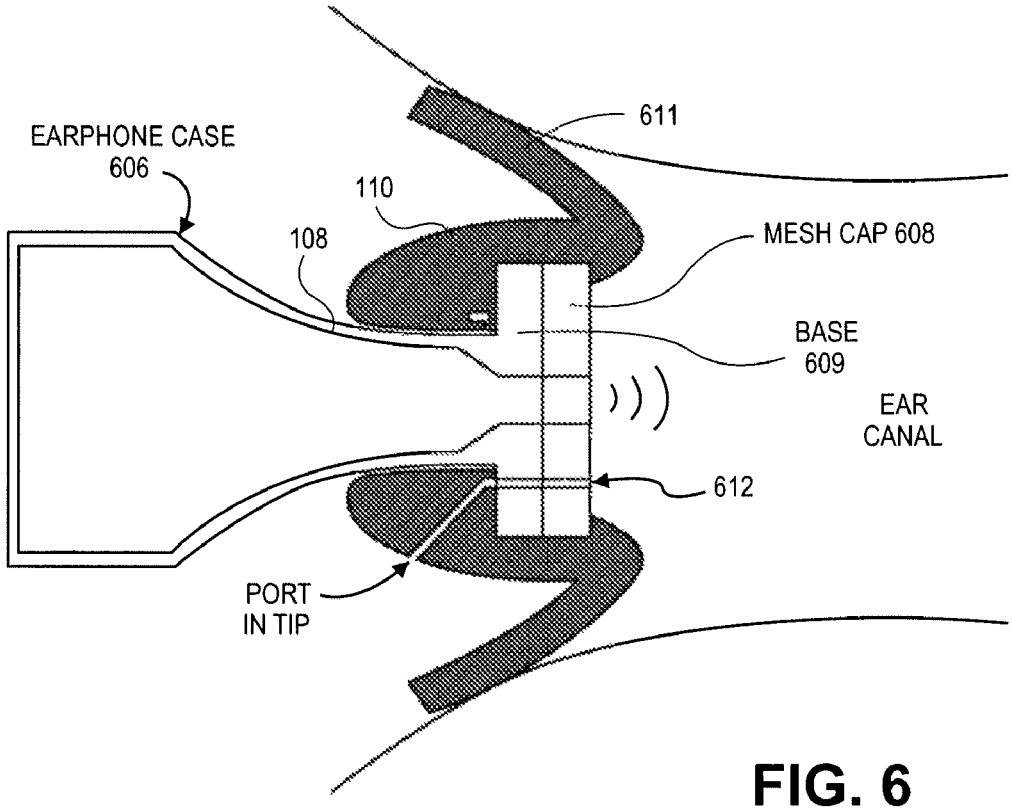
FIG. 6 is a side view of a cross section of an earphone having a ported, case sound output tube wall, in accordance with another embodiment of the invention.

The case sound output tube 108 need not have a perfectly cylindrical shape, for example as shown in FIG. 6. It does have an open far end portion that may be inserted into the ear canal as shown for example in FIG. 3. In particular, the far end portion may be partially inserted into the ear canal while it has been fitted with an ear tip 102 as shown. The tube is a rigid member that may be fitted with a flexible and resilient tip typically made of a rubber or silicone material. The entire tip may be a single manufactured piece, which may be custom molded for the discerning audiophile, or high volume manufactured for the average consumer. The tip may have an inner diameter that is slightly smaller than the outer diameter of the output tube. In that case, the user stretches the tip outward (in a radial direction), to enable it to easily slide (in a longitudinal direction) over the open end of the output tube. The tip is then released, which causes it to collapse inward and grip the output tube. The ear tip 102 has a central opening that lines up with the open far end portion of the tube 108, so that sound pressure waves are directed from the receiver port 103 through an acoustic pathway inside the tube 108, out of the opening of the latter and into the ear canal.

More particularly, and still referring to FIG. 1, the vented ear tip 102 has a core portion 110 that is to be mounted (installed or otherwise fitted) to the sound output tube 108 over its open end portion as shown. To ease this process, the sound output tube 108 may be as rigid as or more rigid then the core portion 110 of the tip 102. Also, the core portion 110, in this example being essentially cylindrical, has an inner diameter that is slightly smaller than the outer diameter of the sound output tube 108, so that the inner diameter is stretched or increased slightly when the tip 102 has been fitted onto the tube 108, as shown. In this embodiment, the core portion 110 should be sufficiently long so as to for example prevent the tip 102 from sliding off the sound output tube 108 during normal use by the wearer inserting the headphone and removing the headphone from her ear canal.

Figure 2:
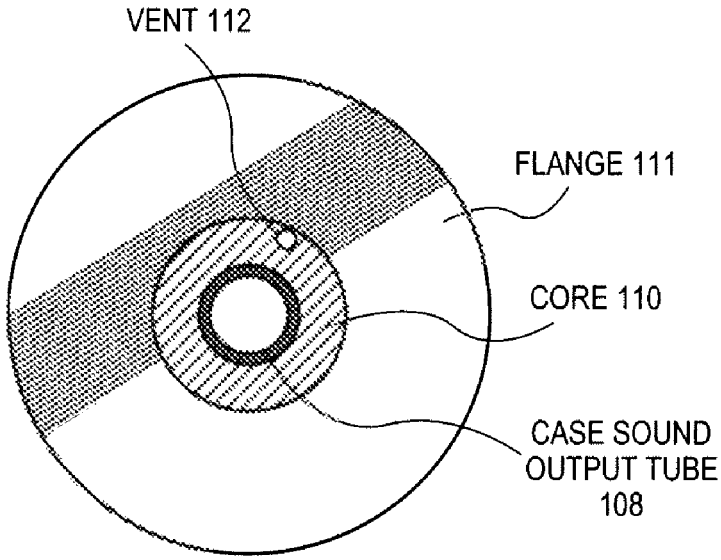
FIG. 2 is a front view of the outside of the vented ear tip of FIG. 1.

The ear tip 102 also has a flange portion 111, which extends outward from and surrounds the core portion 110. This is also depicted in the front outside view shown in FIG. 2. Both the core portion 110 and the flange portion 111 may be made of the same material. The material may be, for example, closed-cell foam or it may be solid silicone or other suitable resilient material. Alternatively, the flange portion 111 may be made of a different material than the core portion 110. The flange portion 111 may be a silicone membrane that is more flexible than the core portion 110.

Figure 3:
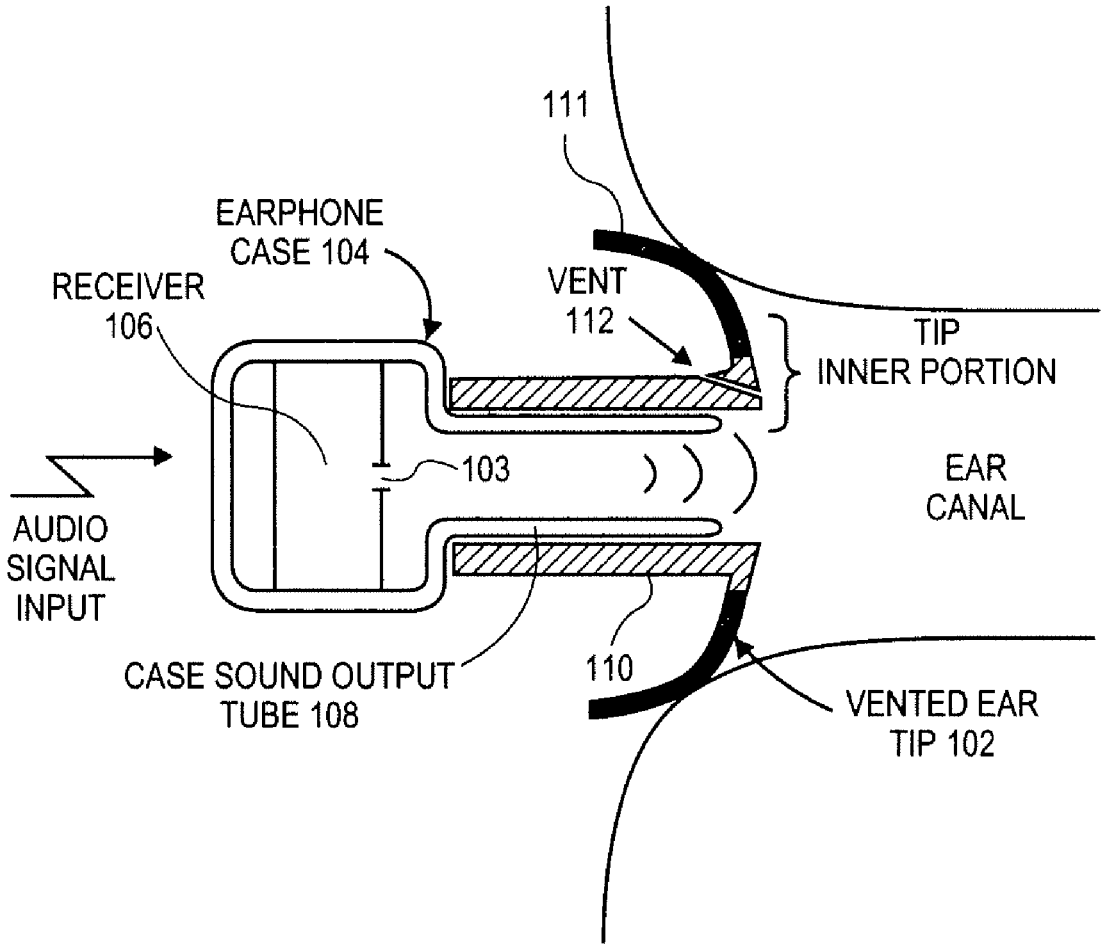
FIG. 3 is a side view of a cross section of the earphone with the installed vented tip, fitted into a user's ear canal.

The flange portion 111 of the tip 102 is shaped and sized to allow the wearer to squeeze its outside surface in a generally radial direction, while inserting the headphone assembly (with the tip installed) into the ear canal, to thereby make an airtight seal all around the outside surface of the flange portion which is in contact with the surface of the ear canal wall. When such a headphone is inserted into the user's ear, the flange portion 111 becomes compressed against the ear canal wall (e.g., as shown in FIG. 3) and thereby creates a sealed or essentially airtight cavity inside the canal. This provides the wearer with good acoustic isolation against external sounds.

Still referring to FIG. 1, bone conduction effects may be ameliorated by providing a vent 112 as follows. The tip 102 has an outer portion formed in the flange portion that is to be in contact with, and thereby form a seal with, the user's ear canal (when the tip has been installed to the sound output tube and fitted to the user's ear, as shown in FIG. 3). In addition, the tip has an inner portion that is spaced inwards from the outer portion to thereby not form the seal with the user's ear canal—see FIG. 3. In other words, the inner portion is spaced inwards from the outer portion to thereby not be in contact with a wall of the user's ear canal. This inner potion has a calibrated, front-to-back perforation or hole formed therein, referred to as the vent 112.

The vent 112 remains open for venting, even when the tip has been installed to the earphone sound output tube and has been fitted to the user's ear. This may be achieved by for example using a different material and/or construction for the inner portion (perhaps including the entire core portion 110) than for the outer portion (perhaps including the entire flange portion 111). The vent 112 is calibrated in the sense that it has been tested or evaluated (in at least one specimen of a manufactured lot) for compliance with a given specification or design parameter. In other words, it is not just a random hole, but it has been intentionally formed for a particular purpose, namely to change the frequency response of the headphone in a way that helps reduce the undesirable effects of bone conduction. For example, the vent 112 may cause the bass response to dovetail downwards, while not substantially impacting the high frequency response, thus reducing and may effectively eliminate low-end bass heard by the wearer, for example below 200 Hz. This is an acceptable loss in performance because it reduces bone conduction effects.

Figure 5:
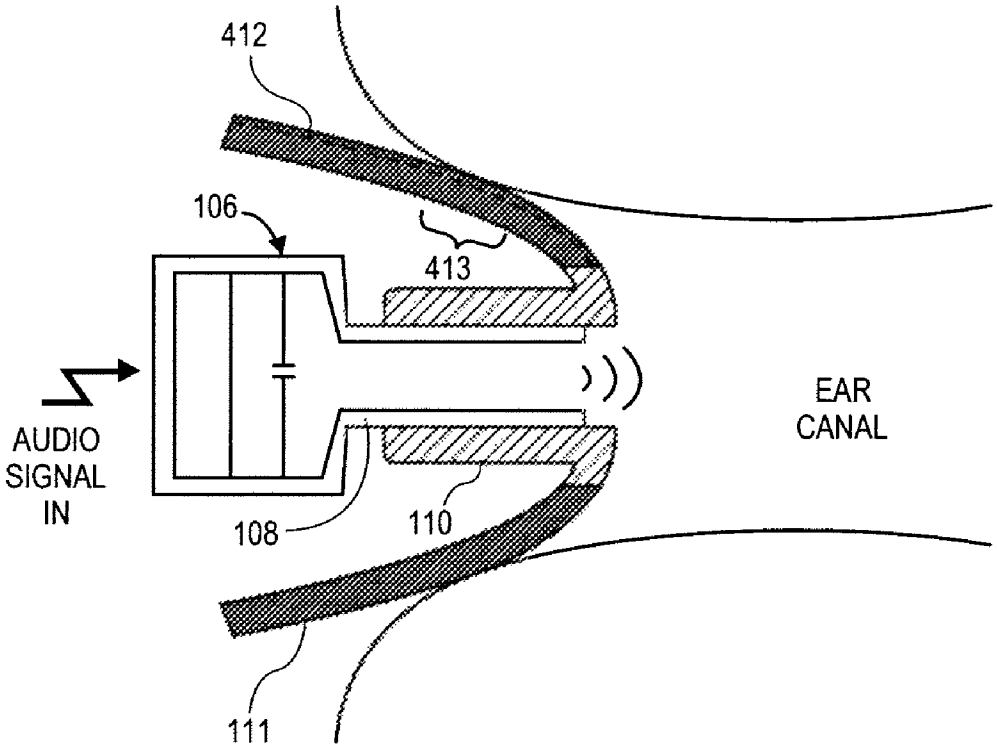
FIG. 5 is a side view of a cross section of an earphone installed with the vented tip of FIG. 4, fitted into a user's ear canal.
Figure 4:
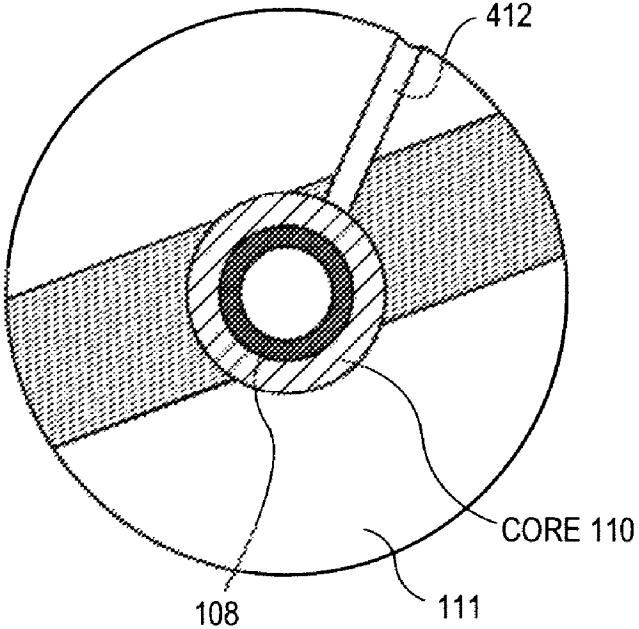
FIG. 4 is a front view of the outside of an ear tip having an open trench formed in its outer surface, in accordance with another embodiment of the invention.

In another embodiment, venting is achieved using a calibrated, open trench or trough 412. This is depicted in FIG. 4 which is a front view of the outside of an ear tip having the open trench 412 formed in its outer surface. The trench is formed on the outer surface of the flange portion 111 and extends generally longitudinally or in a front-to-back direction across a contact section 413 of the flange, as depicted in FIG. 5. The contact section 413 is the intermediate section of the flange portion 111 that will be compressed while in contact with the ear canal wall (when the headphone has been inserted into the wearer's ear as shown). The structure and/or material of at least the contact section 413 should be designed to prevent the trench 412 from collapsing too much (due to the compression forces that are created) when the headphone is inserted into the ear canal, so that sufficient venting takes place through the trench during use of the headphone. The trench 412 should be sized and shaped so that when it is in contact with the ear canal wall as depicted in FIG. 5, it and the contacted surface of the ear canal wall define a vent hole that causes the bass response of the headphone to dovetail downwards, while not substantially impacting the high frequency response, thus reducing or perhaps effectively eliminating low-end bass heard by the wearer, for example below 200 Hz.

In yet another embodiment, a calibrated, vent passage 612 is formed through a wall of the earphone case sound output tube 108. An example of this embodiment is depicted in FIG. 6, which is a side view of a cross section of an earphone having a ported, case sound output tube wall. The vent passage 612 is of course separate from and in addition to the main sound output port of the earphone case 606. In this example, the vent passage 612 is routed or ported, from the free air outside the case, through the wall of the sound output tube 108 and then out the front face of a mesh cap 608 that is connected to and in front of a base 609 of the sound output port 108. Alternatively, instead of out the front face, the vent passage 612 could be routed out the side of the mesh cap 608. In both cases, the vent passage 612 is sized to cause the bass response of the earphone to dovetail downwards, while not substantially impacting the high frequency response, thus reducing and perhaps effectively eliminating low-end bass heard by the wearer, for example below 200 Hz.

In cases where a tip is used that covers the back end of the vent passage 612, the tip itself may need to be ported at a location that lines up with the back end of the passage 612, to allow the covered back end to communicate with free air, as shown in FIG. 6. In that case, the porting within the tip may be considered as formed in the core portion 110 of the tip, as compared to the latter's flange portion 611.

The vent passage that is formed through the wall of the sound output tube has at least two bore segments. A front bore segment may be formed in a cap (e.g., one having a mesh or grill surface as in a typical earphone) that is located in front of a base, the latter being part of the case sound output tube. The front bore segment is open to the occluded cavity in the ear canal. A rear bore segment of the vent passage may be formed in the base and is open to the free air outside the earphone case. The cap may be connected to the base so that it can be manually rotated relative to the base by the wearer, between at least two stable positions or states. In one state, the front and rear segments are aligned to thereby vent the ear canal cavity, while in another state front segment is blocked to thereby not vent the ear canal cavity. This allows the wearer to use the headphone for both a high fidelity mode of operation and a work out or telephone call mode, without having to change the ear tip.

Although two stable venting states have been described in connection with the embodiment of FIG. 6, additional states may also be defined at different rotation positions, corresponding to different degrees of venting. This may be implemented by having one or more additional, front bore segments formed in the cap, each at a different radial angle about the center axis of the cap and each having a different diameter to achieve a different venting level. This allows the wearer to fine tune the level of venting of her headphone, without having to change the ear tip.

Figure 7:
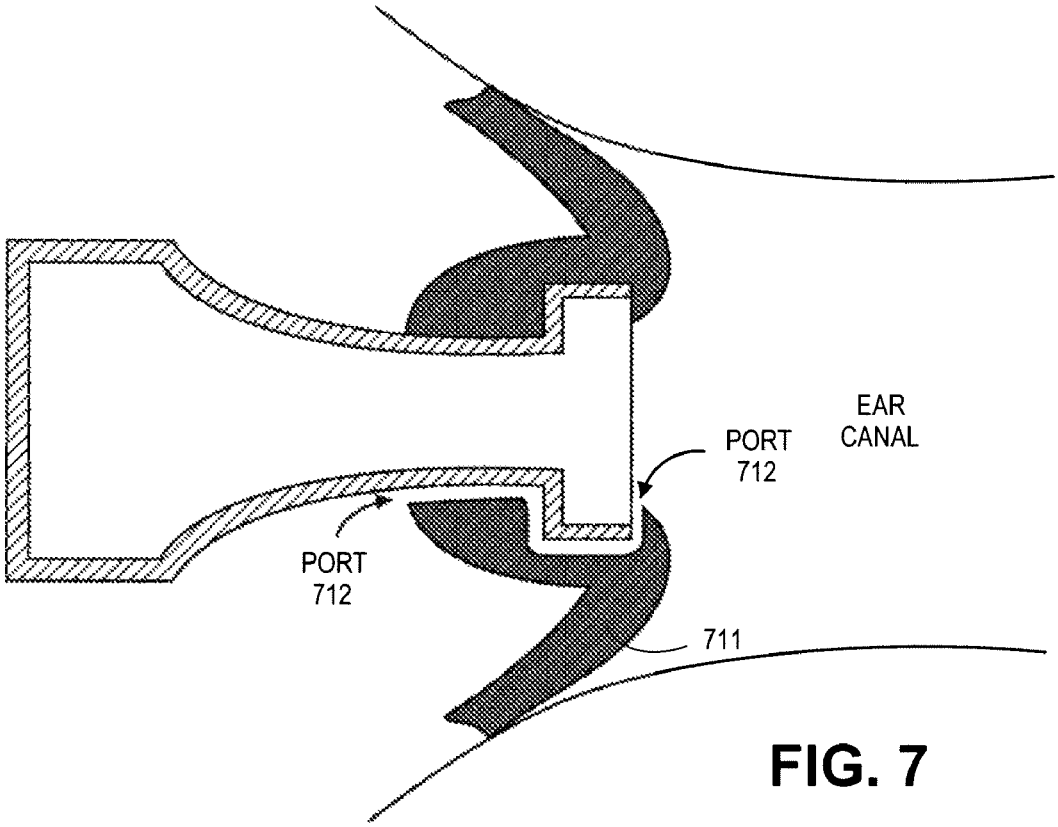
FIG. 7 is side view of a cross section of an earphone fitted with a tip that is ported along its inner surface, in accordance with another embodiment of the invention.

In a further embodiment, venting is achieved by carefully porting the inner surface of the ear tip. This is depicted by the example in FIG. 7, which is side view of a cross section of an earphone fitted with a tip that is ported along its inner surface. Once the tip has been installed in a typical manner onto the earphone case sound output tube 108, a calibrated vent passage or port 712 that runs generally longitudinally or in a front-to-back direction is created, when a trenched inner surface of the ear tip is joined with the outer surface of the case sound output tube, as shown in the figure. This passage 712 extends from the front face of the case sound output tube, which may be located in the ear canal cavity, rearward along the outer surface of the case sound output tube 108, and then opens to the free air outside the case. In this embodiment, the vent passage may be considered as partially formed in the core portion of the tip, as compared to the latter's flange portion. Finally, the trenching of the core portion of the tip should be sized and shaped so that when it is in contact with the outer surface of the case sound output tube, it and the contacted surface define a vent hole that causes the bass response of the headphone to dovetail downwards, while not substantially impacting the high frequency response, thus reducing or perhaps effectively eliminating low-end bass heard by the wearer, for example below 200 Hz.

In the foregoing specification, the invention has been described with reference to specific exemplary embodiments thereof. It will be evident that various modifications may be made thereto without departing from the broader spirit and scope of the invention as set forth in the following claims. For instance, although the flange portions 111, 611, and 711 have been illustrated in the figures as being relatively thin and membrane-like, an alternative here is to have a thicker foam design. In addition, in contrast to a hearing aid, which produces an electrical audio signal from a built-in pick-up and then converts the signal into sound waves, the receiver or driver in an earphone or headphone receives its input electrical signal directly from an external amplifier. This may be via a cable that is connected to a headphone jack of an external, portable, consumer grade digital media storage and playback device such as an IPOD player or an IPHONE communications device (that may also be worn or held by the wearer of the headphone). As an alternative, the earphone may be integrated with a wireless interface (e.g., as a Bluetooth headset) to receive the electrical signal via a wireless connection with the external amplifier. In addition, a passive or active crossover circuit may be built into the headphone housing or the receiver's case, to receive and filter the external electrical signal (prior to being input to a motor of the receiver or driver). The specification and drawings are, accordingly, to be regarded in an illustrative sense rather than a restrictive sense.

What is claimed is:

1. A vented tip for in-the-ear headphones, comprising:

a core portion to be mounted to a sound output tube of an in-the-ear headphone; and a flange portion extending outward from and surrounding the core portion, wherein the vented tip has a) an outer portion formed in the flange portion that is to be in contact with, and thereby form a seal with, a user's ear canal, and b) an inner portion spaced inwards from the outer portion to thereby not form the seal with the user's ear canal, the inner portion having a calibrated perforation formed therein, the calibrated perforation dimensioned to modify a bass frequency response of the headphone without substantially impacting a high frequency response.

2. The vented tip of claim 1 wherein the core portion and the flange portion are made of the same material.

3. The vented tip of claim 2 wherein the material is closed-cell foam.

4. The vented tip of claim 1 wherein the flange portion is a silicone membrane that is more flexible than the core portion.

5. The vented tip of claim 1 wherein the core and flange portions, including the inner and outer portions, form a single, volume manufactured piece.

6. A vented tip for in-the-ear headphones, comprising:

a core portion to be mounted to a sound output tube of an in-the-ear headphone; and a flange portion extending outward from and surrounding the core portion, wherein the vented tip has a trench formed on an outer surface of the flange portion that extends across a contact section of the flange portion, the contact section to be in contact with, and thereby form a seal with, a user's ear canal wall and wherein the trench is dimensioned to modify a bass frequency response of the headphone without substantially impacting a high frequency response.

7. The vented tip of claim 6 wherein the trench extends generally longitudinally or in a front-to-back direction across the contact section.

8. The vented tip of claim 6 wherein one of the structure and material of the contact section prevents the trench from collapsing due to compression forces that are created when the headphone is inserted into the ear canal.

9. An in-the-ear headphone comprising:

an in-the-ear headphone housing containing a receiver that is coupled to a housing sound output tube whose open end is to be inserted into a wearer's ear canal, wherein a calibrated vent passage is formed through a wall of the sound output tube, the vent passage having a front bore segment formed in a front portion of the sound output tube and a rear bore segment formed in a rear portion of the sound output tube, the front and rear portions of the sound output tube being connected to each other so that one can be manually rotated relative to the other, by the wearer, between first and second stable positions, in the first stable position the front and rear bore segments are aligned to thereby vent the ear canal, and in the second stable position the front bore segment is blocked to thereby not vent the ear canal.

10. The in-the-ear headphone of claim 9 further comprising:

a tip to be mounted to the sound output tube, the latter being a rigid member while the former is a flexible member, the tip having a core portion to be mounted to the sound output tube and a flange portion extending outward from and surrounding the core portion, a contact section of the flange portion to be in contact with, and thereby form a seal with, a wall of the wearer's ear canal.

11. The in-the-ear headphone of claim 10 wherein the tip covers a back end of the vent passage, the tip being ported in the core portion at a location that lines up with the back end of the vent passage.

12. The in-the-ear headphone of claim 9 wherein the vent passage is routed from free air outside the housing, through the wall of the sound output tube, and out a front face of the sound output tube.

13. The in-the-ear headphone of claim 9 wherein the front portion of the sound output tube is a cap having a mesh or grill surface that defines the open end of the sound output tube.

14. The in-the-ear headphone of claim 9 wherein the front bore segment has an end that is to always be open to the ear canal and the rear bore segment has an end that is to always be open to the free air outside the housing.

15. A vented tip for in-the-ear headphones, comprising:

a core portion to be mounted to a sound output tube of an in-the-ear headphone; and a flange portion extending outward from and surrounding the core portion, wherein the vented tip has a trench formed on an inner surface of the core portion that is to contact an outer surface of the sound output tube to thereby form a calibrated vent passage, the trench running generally longitudinally from a front face of the tip to a rear face of the tip.

* * * * *